US007983589B2

(12) United States Patent
Sato et al.

(10) Patent No.: US 7,983,589 B2
(45) Date of Patent: Jul. 19, 2011

(54) DEVELOPING APPARATUS, PROCESS CARTRIDGE, AND IMAGE FORMING APPARATUS

(75) Inventors: Masaaki Sato, Suntou-gun (JP); Tomonori Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 749 days.

(21) Appl. No.: 12/020,886

(22) Filed: Jan. 28, 2008

(65) Prior Publication Data

US 2008/0181678 A1 Jul. 31, 2008

(30) Foreign Application Priority Data

Jan. 31, 2007 (JP) ..... 2007-021871

(51) Int. Cl.
*G03G 15/08* (2006.01)

(52) U.S. Cl. ..... 399/102

(58) Field of Classification Search ..... 399/102, 399/103, 105, 106, 111–113, 119, 120, 284
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,528,341 | A | 6/1996 | Shishido et al. | 355/200 |
| 5,585,889 | A | 12/1996 | Shishido et al. | 355/200 |
| 5,940,658 | A | 8/1999 | Yokoi et al. | 399/119 |
| 5,974,288 | A | 10/1999 | Sato | 399/119 |
| 6,075,957 | A | 6/2000 | Batori et al. | 399/114 |
| 6,104,894 | A | 8/2000 | Sato et al. | 399/106 |
| 6,131,007 | A | 10/2000 | Yamaguchi et al. | 399/256 |
| 6,131,011 | A | 10/2000 | Kojima et al. | 399/351 |
| 6,157,792 | A | 12/2000 | Mori et al. | 399/24 |
| 6,178,301 | B1 | 1/2001 | Kojima et al. | 399/98 |
| 6,188,856 | B1 | 2/2001 | Sato | 399/119 |
| 6,298,217 | B1 | 10/2001 | Murayama et al. | 399/358 |
| 6,314,266 | B1 | 11/2001 | Murayama et al. | 399/353 |
| 6,381,420 | B1 | 4/2002 | Sato et al. | 399/27 |
| 6,404,996 | B1 | 6/2002 | Mori et al. | 399/24 |
| 6,640,066 | B2 | 10/2003 | Sato | 399/106 |
| 6,826,380 | B2 | 11/2004 | Karakama et al. | 399/111 |
| 6,895,199 | B2 | 5/2005 | Sato et al. | 399/111 |
| 6,898,399 | B2 | 5/2005 | Morioka et al. | 399/167 |
| 6,937,832 | B2 | 8/2005 | Sato et al. | 399/111 |
| 6,980,759 | B2 | 12/2005 | Kanno et al. | 399/111 |
| 7,149,457 | B2 | 12/2006 | Miyabe et al. | 399/114 |
| 7,155,140 | B2 | 12/2006 | Arimitsu et al. | 399/111 |
| 7,155,141 | B2 | 12/2006 | Sato et al. | 399/114 |
| 7,158,736 | B2 | 1/2007 | Sato et al. | 399/111 |
| 7,218,882 | B2 | 5/2007 | Toba et al. | 399/284 |
| 7,224,925 | B2 | 5/2007 | Sato et al. | 399/263 |
| 7,231,164 | B2 | 6/2007 | Harada et al. | 399/106 |
| 7,283,766 | B2 | 10/2007 | Arimitsu et al. | 399/111 |
| 7,349,657 | B2 | 3/2008 | Sato et al. | 399/263 |

(Continued)

FOREIGN PATENT DOCUMENTS

| | | |
|---|---|---|
| JP | 5-53434 | 3/1993 |

(Continued)

*Primary Examiner* — David M Gray
*Assistant Examiner* — Gregory H Curran
(74) *Attorney, Agent, or Firm* — Fitzpatrick, Cella, Harper & Scinto

(57) ABSTRACT

A developing apparatus detachably mountable to an electrophotographic image forming apparatus having a latent image forming unit provided below a photosensitive drum in the gravitational direction. The apparatus includes a first member and a second member. The first and second members receive falling and flying developer. As a result, contamination in the image forming apparatus caused by the developer falling and flying from the photosensitive drum, the developing roller, a developing blade, and a sealing member of a developing end is reduced.

26 Claims, 8 Drawing Sheets

U.S. PATENT DOCUMENTS

| | | | | |
|---|---|---|---|---|
| 2006/0008289 | A1 | 1/2006 | Sato et al. | 399/106 |
| 2006/0177231 | A1 | 8/2006 | Mori et al. | 399/12 |
| 2006/0269318 | A1 | 11/2006 | Ueno et al. | 399/106 |
| 2008/0025757 | A1 | 1/2008 | Sato et al. | 399/111 |

FOREIGN PATENT DOCUMENTS

| | | | | |
|---|---|---|---|---|
| JP | 05053434 | A | * | 3/1993 |
| JP | 2005-173227 | | | 6/2005 |
| JP | 2006-145815 | | | 6/2006 |

* cited by examiner

DEVELOPING APPARATUS, PROCESS CARTRIDGE, AND IMAGE FORMING APPARATUS

BACKGROUND OF THE INVENTION

1. Field of the Invention

The present invention relates to a developing apparatus, a process cartridge, and an image forming apparatus, and more particularly, this invention is suitably applied to an image forming apparatus such as a copying machine and a printer that adopt an electrophotographic method, and form an image on a recording medium.

2. Description of the Related Art

When a developer (toner) falls or flies from a developing apparatus or a process cartridge, an image forming apparatus is contaminated by the developer, and thus defective images may occur.

Therefore, there is proposed a fly developer containing portion for receiving falling or flying developers being provided in a conventional image forming apparatus, a developing apparatus or a process cartridge. More specifically, for example, there is proposed a fly developer containing portion provided integrally with a developing blade on the downside thereof. See Japanese Patent Application Laid-Open No. 5-53434. The developer flying from the tip of the developing blade is contained in the fly developer containing portion. It should be noted that the developing blade as described herein forms developer into a thin layer, the developer being supplied from the developer containing portion to a developing roller serving as a developing unit.

In an image forming apparatus, a developing apparatus and a process cartridge as previously described, a developer falling or flying from a photosensitive drum, a developing roller or a developing blade, can be contained in the mid-area of the developing roller in the longitudinal direction. However, due to powder pressure of the developer contained in the mid-area of the developing roller in the longitudinal direction, the contained developer is forced to move or suspended to both ends of the developing roller in the longitudinal direction, and eventually may fall or fly from the both ends of the fly developer containing portion into the image forming apparatus.

Also, the developing apparatus and the process cartridge are adapted to be detachably mountable to the main body of the image forming apparatus. For this reason, due to a shock occurring during detaching or mounting operation of the developing apparatus or the process cartridge by an user, a fly developer contained in the fly developer containing portion may be moved to the both ends of the developing roller in the longitudinal direction, and eventually may fall or fly therefrom.

SUMMARY OF THE INVENTION

Therefore, the present invention provides a developing apparatus, a process cartridge and an image forming apparatus capable of preventing a developer from falling from a developing roller.

The present invention further provides a developing apparatus, a process cartridge, or an image forming apparatus including: a developing roller developing a latent image formed onto an image bearing member; a developing frame having an opening portion from which a portion of the developing roller is exposed; a first member, provided spaced apart from the developing roller along a longitudinal direction of the developing roller, for receiving a developer falling from an exposed portion of the developing roller to prevent the developer from falling further; and a second member for receiving a developer that falls passing through the outer side of the first member in the longitudinal direction to prevent the developer from falling further.

DETAILED DESCRIPTION OF THE EMBODIMENTS

Figure 1:
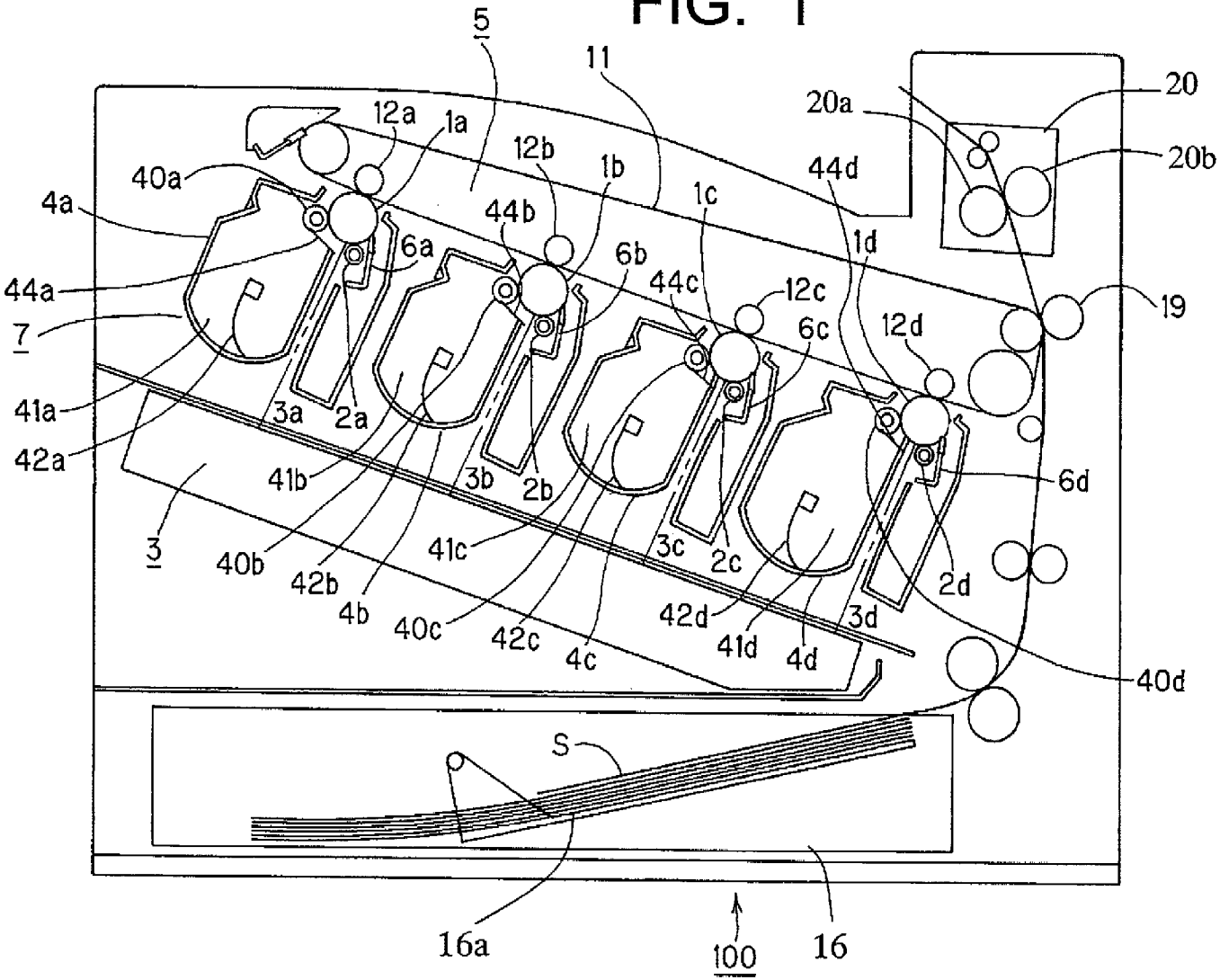
FIG. 1 is a cross-sectional view illustrating an image forming apparatus according to a first embodiment of the present invention.

Hereinafter, the embodiments of the present invention will be described with reference to the accompanying drawings. Incidentally, for all of the drawings of the following embodiments, the same reference numerals and symbols will be designated to the same or corresponding portions.

Hereinafter, a first embodiment of the present invention will be described. FIG. 1 illustrates a general construction of a full-color laser beam printer as an example of an image forming apparatus.

As illustrated in FIG. 1, an image forming apparatus 100 includes four photosensitive drums 1(1*a*, 1*b*, 1*c*, and 1*d*) serving as image bearing members provided side by side in a direction substantially perpendicular to a gravitational direction (hereinafter referred to as substantially horizontal direction). The photosensitive drum 1 is driven to rotate by a drive unit (not shown) in a clock-wise direction in FIG. 1. Around the photosensitive drum 1, a charging device 2, a scanning unit 3, a developing apparatus 4, an electrostatic transfer device 5, and a cleaning blade 6 are disposed in the recited order according to rotational direction thereof.

The charging devices 2 (2*a*, 2*b*, 2*c*, and 2*d*) are provided on outer circumferential surfaces of the photosensitive drums 1 serving as image bearing members, for uniformly charging photoconductive layers, respectively. The charging devices 2 are electrically conductive rollers serving as primary charging units. The surfaces of the photosensitive drums 1 will be uniformly charged by causing the conductive rollers to abut against the photosensitive drums 1, as well as by applying charging bias voltage onto the conductive rollers.

The scanning units 3 (3*a*, 3*b*, 3*c*, and 3*d*) serving as latent image forming units, irradiating a laser beam based on image information to form an electrostatic latent image on the photosensitive drums 1. That is, the scanning units 3 selectively expose the surfaces of charged photosensitive drums 1 to image light of a laser beam, for example, by laser diode (not shown), corresponding to image signal to form an electrostatic latent image. The scanning units serving as latent image forming units that form an electrostatic latent image on the charged surface of the photosensitive drums 1 are provided below in the gravitational direction relative to the photosensitive drums 1.

The developing apparatuses 4 (4*a*, 4*b*, 4*c*, and 4*d*) cause toners as developers to adhere to electrostatic latent images to develop them as toner images, and form visualized images.

The developing apparatuses 4 have developer containing portions 41 (41*a*, 41*b*, 41*c*, and 41*d*) for containing developers of yellow, magenta, cyan, and black, respectively. The developers contained within the developer containing portions 41 are conveyed to the developing rollers 40 (40*a*, 40*b*, 40*c*, and 40*d*) through developer conveyance mechanisms 42 (42*a*, 42*b*, 42*c*, and 42*d*). Then, the developers that have been supplied to the developing rollers 40 are applied on the outer circumferences of the developing rollers 40 that rotate in a counterclockwise direction in FIG. 1, by developing blades 44 that are in pressure contact with the outer circumferences of the developing rollers 40. Also, the developers are regulated so as to form a predetermined developer thin layer, and the desired amount of electrified electric charge is imparted to the developers. Then, toner development is performed on photosensitive drums 1 depending on latent images by applying developing bias to the developing rollers 40 opposed to the photosensitive drums 1 on which the latent images have been formed.

The electrostatic transfer device 5 causes a toner image on the photosensitive drums 1 to be transferred to a transferring material S. Cleaning blades 6 (6*a*, 6*b*, 6*c*, and 6*d*) remove un-transferred residual toner that have remained on the surface of photosensitive drums 1 after transferring. It should be noted that, in FIG. 1, the electrostatic transfer device 5 is illustrated as an intermediate transfer unit that includes an intermediate transfer member and a housing relating thereto. However, a transfer and conveyor unit can be also adopted that includes a transfer and conveyor member for placing a transferring material S on a surface opposed to the photosensitive drums 1 and performing transfer and conveyance, and a housing relating thereto.

As described above, the photosensitive drum 1 as an image bearing member, the charging device 2 as a charging unit, the developing apparatus 4 and the cleaning blade 6 are integrally incorporated into a cartridge, thus constructing a process cartridge 7. This process cartridge 7 is adapted to be detachably mountable to the main body of the image forming apparatus 100.

In the electrostatic transfer device 5, there is disposed an intermediate transfer belt 11 that circulates so as to be opposed to and in contact with all photosensitive drums 1*a*, 1*b*, 1*c*, and 1*d*. Toner images on the photosensitive drums 1*a*, 1*b*, 1*c*, and 1*d* are subjected to a primary transfer in succession onto the intermediate transfer belt 11. The toner images transferred on the intermediate transfer belt 11 circulates in a counterclockwise direction in FIG. 1, and is transferred onto the transferring material S by a secondary transfer device 19.

Four transfer rollers 12 (12*a*, 12*b*, 12*c*, and 12*d*) abut against the inner side of the intermediate transfer belt 11, respectively, and are arranged side by side at locations opposed to the four photosensitive drums 1*a*, 1*b*, 1*c*, and 1*d*, respectively. Bias of positive polarity is applied to these transfer rollers 12 during transferring, and electric charge of positive polarity is applied to the intermediate transfer belt 11. By an electric field generated at this moment, a toner image of negative polarity on the photosensitive drum 1 is transferred to the intermediate transfer belt 11 being in contact with the photosensitive drum 1. A sheet feeding portion 16 contains a plurality of transfer materials S. The transfer materials S in a sheet feeding cassette 16*a* are separated and fed one by one to the secondary transfer device 19. A fixing portion 20 comprises a rotatable heat roller 20*a* and a pressure roller 20*b*, which is in pressure contact with the heat roller 20*a* to apply heat and pressure to the transfer material S. When the transfer material S, on which the toner image has been transferred from the photosensitive drum, passes the fixing portion 20, the transfer material S is conveyed by the pressure roller 20*b* while being subjected to the heat and pressure so that a toner image of plural colors is fixed on a surface of the transfer material S. After the toner image is heat-fixed on the transfer material S by the fixing portion 20, a sheet discharge roller (not shown) discharges the transfer material S to the outside of the apparatus main body.

(Construction of Process Cartridge)

Figure 2:
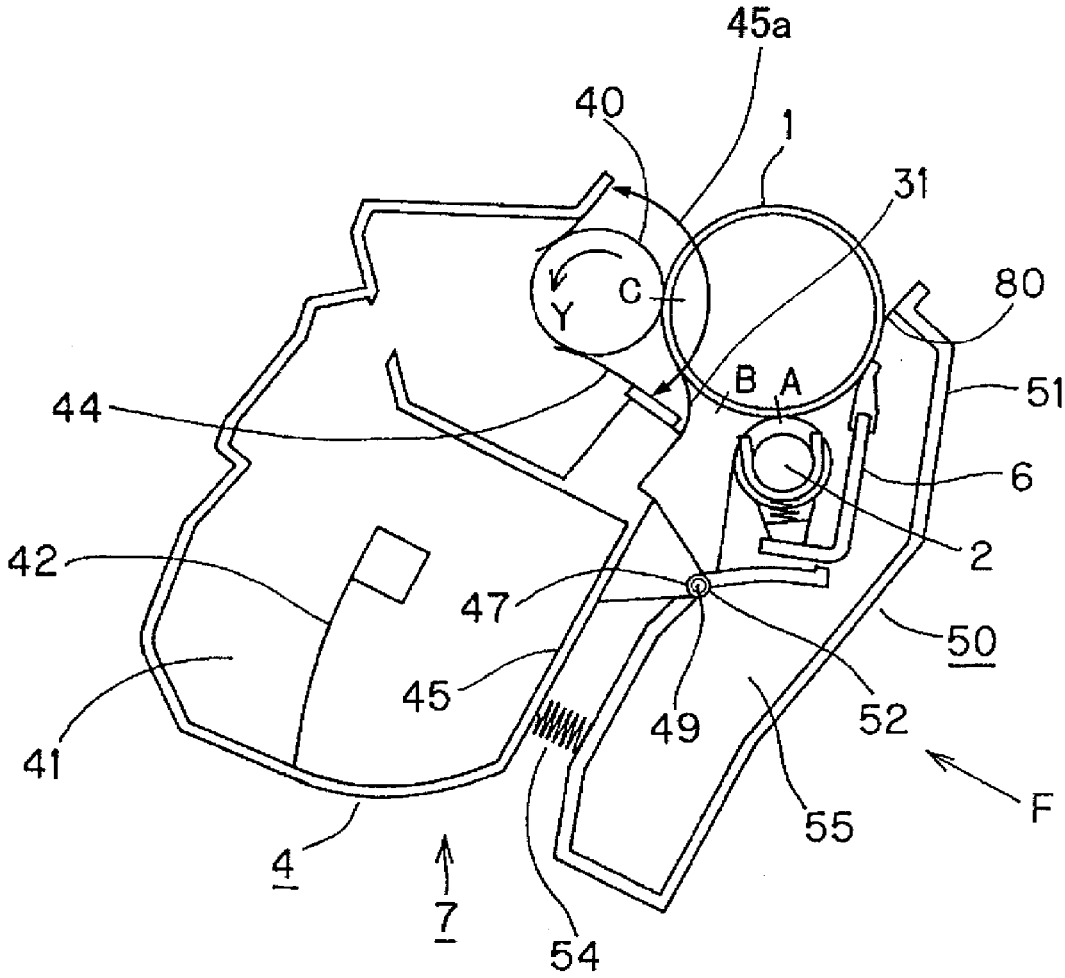
FIG. 2 is a cross-sectional view illustrating a developing apparatus and a process cartridge according to the first embodiment of the present invention.

Next, a process cartridge according to an embodiment of the present invention will be described. FIG. 2 illustrates a main cross-sectional view of a process cartridge 7 containing a developer.

As illustrated in FIG. 2, the process cartridge 7 according to the first embodiment is divided into a cleaning unit 6 having a photosensitive drum 1, a charging device 2, a cleaner unit 50, and a developing apparatus 4 having a developing roller 40 for developing an electrostatic latent image on the photosensitive drum 1.

On the circumference of the photosensitive drum 1, there is disposed the above-mentioned charging device 2 serving as the primary charging unit, a cleaning blade 6 for removing a developer (residual toner) that has remained on the photosensitive drum 1 after transferring, and a flexible sheet member 80.

Also, residual toner, so-called waste toner that has been removed from the surface of photosensitive drum 1 by the cleaning blade 6 is contained in a waste toner chamber 55 provided in a cleaning frame 51. Also, un-transferred residual toner that has remained on the surface of the photosensitive drum 1 reaches the location of the cleaning blade 6 passing through a drum abutting portion of the flexible sheet member 80. An abutting condition for the flexible sheet member 80 is set, so that the residual toner removed from the drum by this cleaning blade 6 may not be leaked from the cleaning frame 51 to the outside.

Also, the developing apparatus 4 includes: a developing roller 40, a developer containing portion 41, and a developing frame 45. Here, the developing frame 45 has a development opening portion 45*a* for allowing one portion of the developing roller 40 to be exposed. The developing roller 40 rotates in the direction of an arrow Y while abutting against the photosensitive drum 1. The developer containing portion 41 is constructed to be capable of containing a developer.

Figure 4:
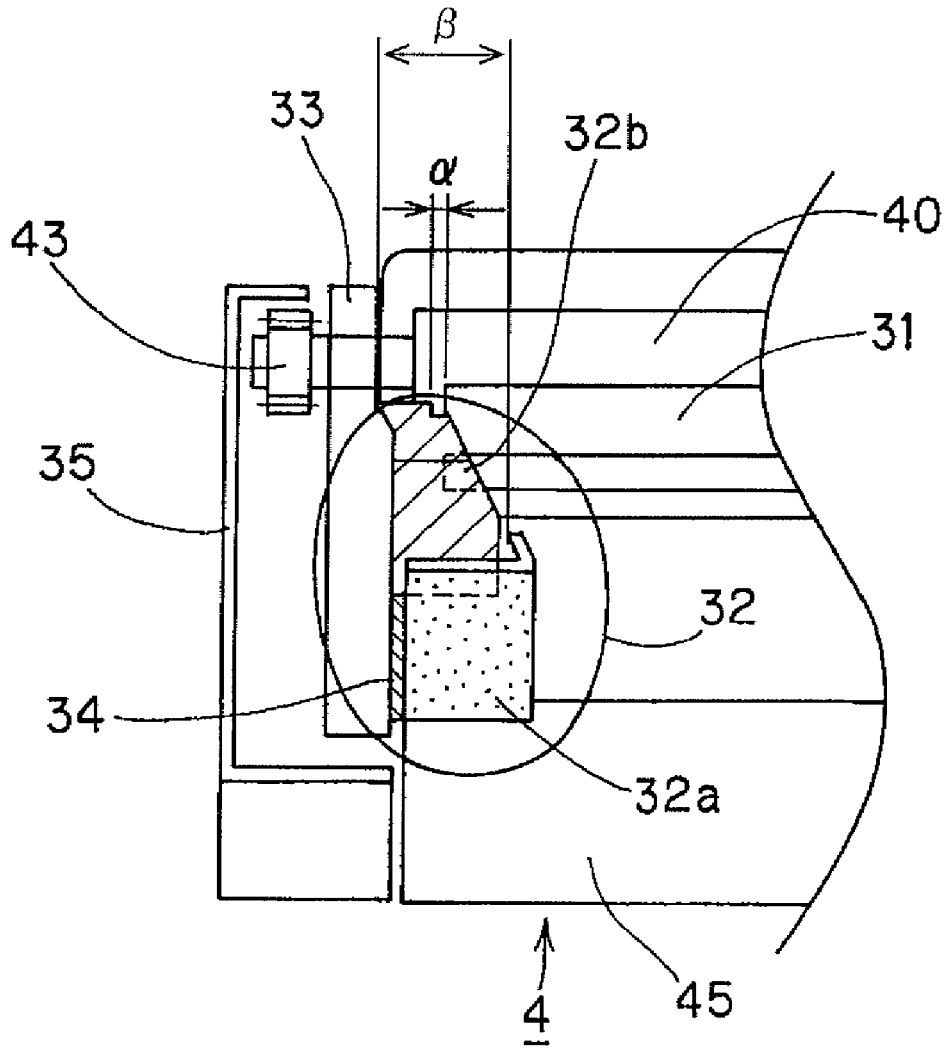
FIG. 4 is a front view illustrating the developing apparatus and the process cartridge according to the first embodiment of the present invention.

The developing roller 40 is supported rotatably by the developing apparatus 4 via bearing members 33 (FIG. 4). Also, developing blades 44 (44*a*, 44*b*, 44*c*, and 44*d*) are arranged on the circumferential surfaces of the developing rollers 40. In addition, a developer conveyance mechanism 42 for agitating the contained developer as well as conveying the developer to the developing roller 40 is provided in the developing apparatus 4.

Further, the developing apparatus 4 is of a hanging construction supported pivotally with respect to the cleaner unit 50. That is, a connecting hole 47 provided at the both ends of the developing apparatus 4 and a supporting hole 52 provided at the both ends of the cleaning frame 51 of the cleaner unit 50 are aligned to allow a pin 49 to be inserted from each of the both ends of the cleaner unit 50. Further, the developing apparatus 4 is always pressed by a pressure spring 54 about the supporting hole 52 so that the developing roller 40 may be brought into contact with the photosensitive drum 1.

Developer that has been rendered as a thin layer on the surface of the developing roller 40 is conveyed along with the rotation of the developing roller 40 to a developing portion where the photosensitive drum 1 and the developing roller 40 are opposed to each other. Here, the developing portion refers to, in the case of a contact development, a portion where the photosensitive drum 1 and the developing roller 40 are in closest contact with each other, while in the case of non-contact development, a portion where the photosensitive drum 1 gets to the closest point to the developing roller 40, but out of contact with the developing roller 40. In the developing portion, a developing bias is applied from a power supply (not shown) to the developing roller 40, whereby the developer adheres to an electrostatic latent image formed on the surface of the photosensitive drum 1, and consequently the latent image is developed.

Here, a developer that has remained on the surface of the developing roller 40 without contributing to the development of the electrostatic latent image is returned and recycled into a developer container along with the rotation of the developing roller 40.

Next, a member according to the first embodiment of the present invention will be described. As illustrated in FIG. 2, a first member 31 is attached in the developing apparatus 4 (a developing frame 45). The first member 31 is provided at a lower portion in gravitational direction than the developing roller 40 and the photosensitive drum 1. Also, the first member 31 is provided spaced apart relative to the developing roller 40. The first member 31 is provided along a longitudinal direction of the developing roller 40. The first member 31 is constructed of, for example, a flexible sheet material. One end of the first member 31 in the transverse direction is fixed to the developing frame 45, while the other end in the transverse direction is attached facing toward the photosensitive drum 1, and the other end of the first member 31 in the transverse direction is allowed to abut against the surface layer of the photosensitive drum 1. The first member 31 receives a developer that has fallen from an exposed area of the developing roller 40 to prevent the developer from falling further.

In the present example, a closed space is formed by the developing roller 40, the developing blade 44, the photosensitive drum 1 and the first member 31, whereby restraining a developer from falling or flying from an exposed portion of the developing roller 40 or the developing blade 44. Also, as previously described, in the case where the first member 31 comprises the flexible sheet member, the tip of the first member 31 is allowed to abut against the circumferential surface (charged surface) of the photosensitive drum 1. As a result, the developer can be prevented from falling or flying therefrom, and contamination resulting from falling or flying of the developer can be prevented more fully.

Especially in a developing apparatus or a process cartridge where the developing roller 40 is provided at a higher position in the gravitational direction than a scanning unit 3, it is necessary to prevent the developer from falling so as to not cause the scanning unit 3 to be contaminated by developer falling or flying from the developing roller 40 or the developing blade 44.

Figure 3:
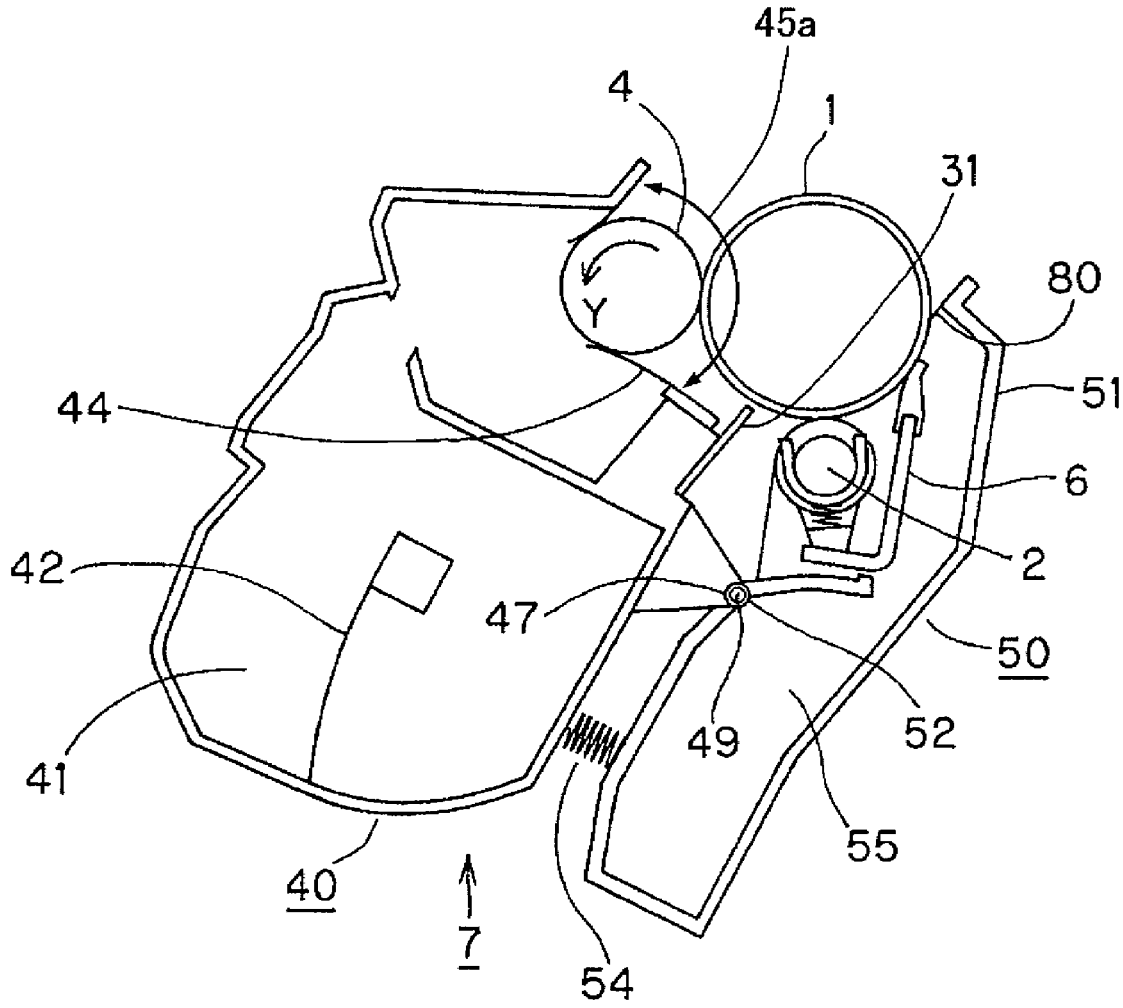
FIG. 3 is a cross-sectional view illustrating the developing apparatus and the process cartridge according to the first embodiment of the present invention.

In this case, it is desirable to locate an abutting position of the first member 31 against the photosensitive drum 1, as illustrated in FIG. 2, at a downstream side in drum's rotational direction of an abutting position A of the charging device 2 against the photosensitive drum 1 and a position B where a latent image is formed on the photosensitive drum 1 by the scanning unit 3. Further, it is desirable to locate an abutting position of the first member 31 against the photosensitive drum 1 on an upstream side in drum's rotational direction of an abutting position C against the developing roller 40. It is noted that, as illustrated in FIG. 3, the first member 31 may be constructed of a rigid body, and in this case, one end thereof is attached at a position in proximity to the photosensitive drum 1. It is noted that, from viewpoints of manufacturing tolerances and certainty of operation, it is desirable to use a flexible sheet member rather than a rigid body for the first member 31.

Figure 5:
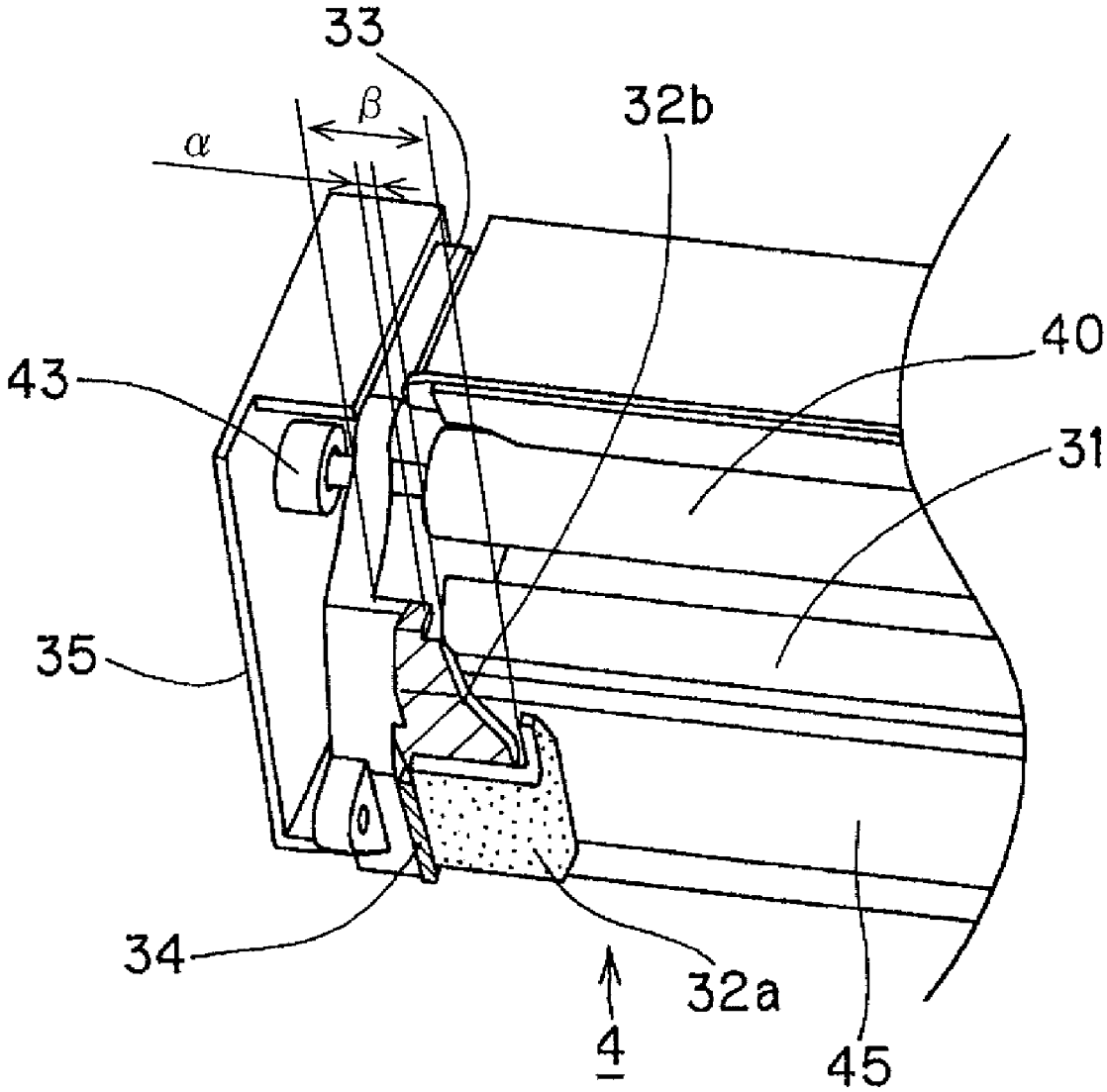
FIG. 5 is a perspective view illustrating the developing apparatus and the process cartridge according to the first embodiment of the present invention.

FIG. 4 illustrates one portion in the longitudinal direction of the developing apparatus 4 and the process cartridge 7 when overviewing the developing apparatus 4 along the direction indicated by the arrow F in FIG. 2, and FIG. 5 illustrates a perspective view thereof.

Both ends of the developing roller 40 in its axial direction (longitudinal direction) are rotatably supported by bearing members 33 serving as an end member. At a longitudinal end of the developing roller 40, there is mounted a drive member 43 for imparting a rotational driving force to the developing roller 40. FIG. 4 illustrates a case where the drive member 43 is a gear.

As illustrated in FIG. 4 and FIG. 5, the first member 31, one end of which is fixed to the developing apparatus 4, is mounted over the whole mid-area of the developing roller 40 in the longitudinal direction (axial direction) other than a portion of a gap "α" with respect to the bearing member 33 situated at the longitudinal end along the axial direction of the developing roller 40. Thus, the first member 31 prevents a developer from falling or flying from at least one of the developing roller 40, developing blade 44 and the photosensitive drum 1 in the longitudinal mid-area of the developing roller 40 in the axial direction. Therefore, contamination within an image forming apparatus 100, or within the scanning unit 3 situated at a lower portion in the gravitational direction than the developing roller 40 can be reduced.

In order to more fully prevent contamination within the image forming apparatus resulting from the developers falling or flying from the developing roller 40 and the developing blade 44, it is desirable that the above-mentioned gap "α" is not exist. However, if respective dimensional accuracies of discrete components of the developing apparatus 4, the developing roller 40, the developing blade 44, the bearing member 33 and the first member 31 are taken into consideration, it is extremely difficult to make the gap "α" zero.

Now, in the first embodiment, there is provided a second member 32 (32*a*, 32*b*) as a second portion for receiving a developer that has fallen from the gap "α" between the first member 31 and the bearing member 33 to regulate the developer from falling. In other words, the second member 32 receives a developer that has passed through the outer side of the first member 31 in the longitudinal direction (the axial direction) of the developing roller 40 to prevent the developer from falling further. Here, if the second member 32 and the first member 31 are projected on a parallel line parallel to the longitudinal direction, a region corresponding to the end of the first member 31 is included in a region corresponding to the second member 32.

The developer that has fallen or flown from the developing roller 40 and the developing blade 44 and has been prevented from flying in the mid-area of the first member 31 along the longitudinal direction are forced to move toward the longitudinal end (axial end) of the developing roller 40, and the developer is suspended and flown to the longitudinal end of the developing roller 40. When the developer at the longitudinal end of the developing roller 40 reaches the portion of the gap "α" between the first member 31 and the bearing member 33, they eventually may fall or fly downward in the gravitational direction. Here, the developer is again prevented from falling or flying therefrom by the second member 32 arranged at an overlapping position with the portion of the gap "α" along the axial direction of the developing roller 40. Incidentally, the second member 32 is also provided below the developing roller 40 and the photosensitive drum 1.

FIG. 4 illustrates an example in which one portion 32*b* of the second member 32 is formed integral with the bearing member 33 serving as an end member. Thereby, one portion 32*b* of the second member can be provided at a position where the position of the portion of the gap "α" and an opening portion "β" of the second member 32 are securely overlapped each other in the axially longitudinal direction of the developing roller 40.

Further, the other portion 32*a* of the second member 32 is provided integrally with the developing frame 45. A blind hole configuration for retaining and containing developer prevented from falling or flying is formed by the one portion 32*b* and the other portion 32*a*. In the case where a gap appears between the one portion 32*b* and the other portion 32*a*, it is advisable to fill the gap with a sealing member 34 made up of, for example, urethane foam.

The blind hole configuration of the second member 32 is shaped to be opened upward in the gravitational direction. The second member 32 is formed from the one portion 32*b* and the other portion 32*a*. Thereby, developer falling or flying from at least one of the developing roller 40 (developing blade 44), and the photosensitive drum 1 and flying developer resulting from frictional sliding between the developing roller 40 and the sealing member of the developing end, can be reduced. Also with respect to a shock occurring during detaching or mounting operation of the developing apparatus and the process cartridge from/to an image forming apparatus by a user, the possibility that a developer would fly can be reduced.

Figure 6:
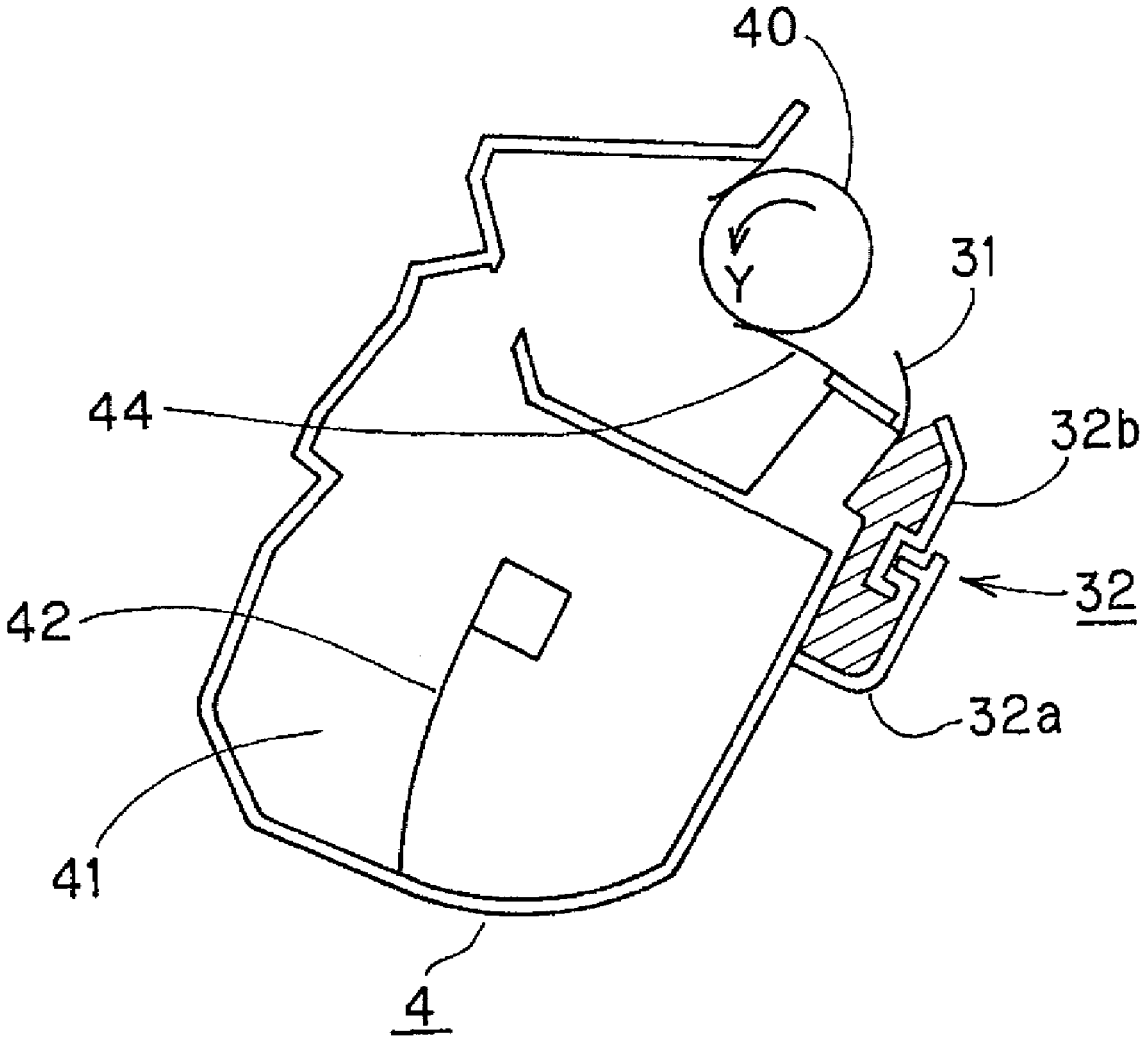
FIG. 6 is a cross-sectional view illustrating the developing apparatus and the process cartridge according to the first embodiment of the present invention.

FIG. 6 illustrates a positional relationship of the second member 32*a*, 32*b* as viewed from the cross-sectional direction of the developing apparatus and the process cartridge. As illustrated in FIG. 6, a convex portion is provided at the one of the portions 32*a* and 32*b* of the second member, and a concave portion at the other. In the present embodiment, the convex portion provided at the other portion 32*a* is inserted into and abut against the concave portion provided at the one portion 32*b*. Thereby, when the second member 32 is assembled, the scatter and loss of the developer is prevented by the convex portion at the other portion 32*a*. Then, the labyrinth configuration can help to prevent the developer retained and contained within the second member 32 from leaking to the outside of the process cartridge. Incidentally, reverse arrangement of the convex portion and the concave portion may be possible.

In addition, as described above, the second member 32 in the blind hole configuration comprises a plurality of members, so that an opening portion of the blind hole configuration is narrowed down and the volume within the second member 32 can be increased. As a result, this can help to prevent the developer retained and contained within the second member 32 from readily leaking to outside of the process cartridge.

Second Embodiment

Figure 7:
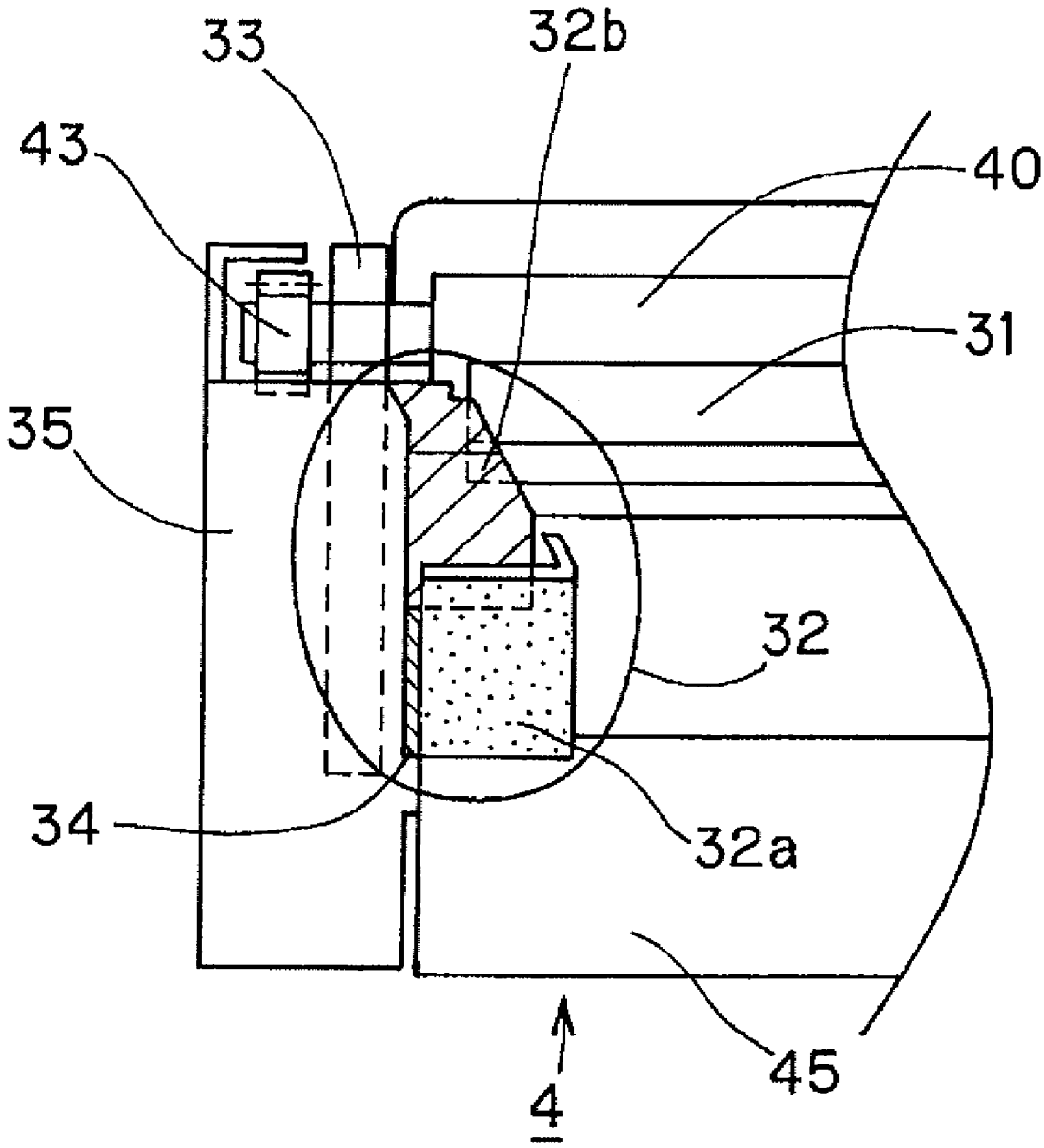
FIG. 7 is a front view illustrating a developing apparatus and a process cartridge according to a second embodiment of the present invention.
Figure 8:
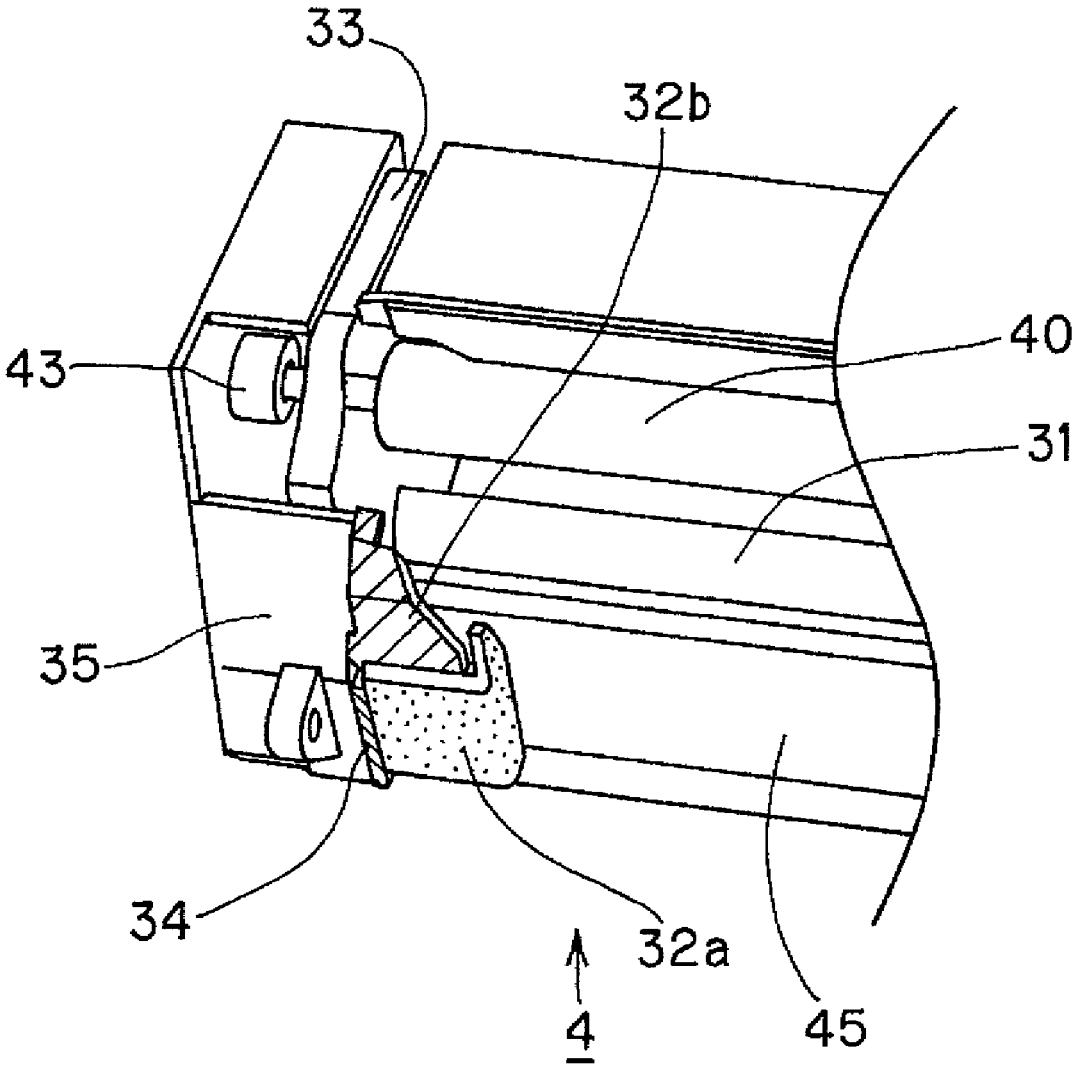
FIG. 8 is a perspective view illustrating the developing apparatus and the process cartridge according to the second embodiment of the present invention.

Next, a developing apparatus and a process cartridge according to the second embodiment of the present invention will be described. FIG. 7 illustrates one portion in the longitudinal direction of the developing apparatus and the process cartridge according to the second embodiment, and FIG. 8 illustrates a perspective view thereof. Incidentally, for the configuration like that in the first embodiment, the description will be omitted.

As illustrated in FIG. 7 and FIG. 8, a cover member 35 serving as an end member is provided at the longitudinal outermost portion of the process cartridge 7. The cover member 35 covers (protects) a drive member 43 arranged at the end in the axial longitudinal direction of the developing roller 40 serving as a developing unit of the developing apparatus and the process cartridge so that it may not be exposed to the outside of the process cartridge.

In the second embodiment, the one portion 32*b* is formed integrally with the cover member 35, and the other portion 32*a* is formed integrally with the developing frame 45. Then, the one portion 32*b* and the other portion 32*a* are put together and constructed to have an opening portion only at the upper portion along the gravitational direction. In general, the bearing member 33 rotatably retains the developing roller 40, and it is necessary to keep its relative positional relationship with the developing blade 44 and the developing frame 45 with a high accuracy throughout the lifetime of a process cartridge 7, and accordingly it is constructed of an expensive material. Contrary to this, since the cover member 35 is not intended to position a process unit such as the developing roller 40 with high accuracy, it is formed with relatively inexpensive material. Hence, in the second embodiment, the one portion 32*b* of the second member is formed integrally with the cover member 35. Thereby, a reduction in cost of the whole process cartridge can be achieved.

While the present invention has been described as above with reference to exemplary embodiments, it is to be understood that the invention is not limited to the disclosed exemplary embodiments. Various modifications based on technical idea of the present invention are possible. For example, materials listed in the above-mentioned embodiments are strictly only for the purpose of examples, different materials from these may be used as necessary. Also, only one portion of the end member may constitute the second member 32. In this case, however, the foregoing effect of the second member 32 being formed by a plurality of the portions cannot be obtained. Also, the developing apparatus 4 may be detachably mountable to the apparatus main body of the image forming apparatus 100.

This application claims the benefit of Japanese Patent Application No. 2007-021871, filed Jan. 31, 2007, which is hereby incorporated by reference in its entirety.

What is claimed is:

1. A developing apparatus comprising:

a developing roller developing a latent image formed onto an image bearing member;

a developing frame having an opening portion through which a portion of the developing roller is exposed;

a first member, provided spaced apart from the developing roller along a longitudinal direction of the developing roller, for receiving a developer falling from an exposed portion of the developing roller and prevent the developer from falling further; and a second member for receiving the developer that falls passing an outside of the first member in the longitudinal direction to prevent the developer from falling further.

2. A developing apparatus according to claim 1, wherein the first member is provided in contact with a circumferential surface of the image bearing member.

3. A developing apparatus according to claim 1, wherein the first member is a sheet member having flexibility.

4. A developing apparatus according to claim 1, wherein the first member is provided on the developing frame.

5. A developing apparatus according to claim 1, wherein the developing apparatus has an end member mounted at an end portion of the developing frame in the longitudinal direction, and wherein the second member receives the developer that falls from a gap between the first member and the end member.

6. A developing apparatus according to claim 5, wherein the end member serves as a bearing member for rotatably supporting the developing roller with respect to the developing frame.

7. A developing apparatus according to claim 5, wherein the end member serves as a cover member for covering an end portion of the developing roller in the longitudinal direction.

8. A developing apparatus according to claim 5, wherein at least one portion of the second member is provided at the end member.

9. A developing apparatus according to claim 8, wherein the other portion of the second member is provided at the developing frame.

10. A developing apparatus according to claim 9, wherein a concave portion is provided at one of the one portion and the other portion, while a convex portion is provided at the other of the one portion and the other portion, and the convex portion is inserted into the concave portion.

11. A developing apparatus according to claim 1, wherein the second member has a blind hole configuration being opened upwardly.

12. A developing apparatus according to claim 1, wherein, assuming that the second member and the first member are projected to a line parallel to the longitudinal direction, a projected area corresponding to an end portion of the first member is included in a projected area corresponding to the second member.

13. A developing apparatus according to claim 1, wherein the developing apparatus is detachably mountable to a main body of an image forming apparatus.

14. A process cartridge detachably mountable to a main body of an image forming apparatus, the process cartridge comprising:

a developing apparatus as recited in claim 1; and an image bearing member.

15. An image forming apparatus comprising:

an image bearing member;

a developing roller developing a latent image formed on the image bearing member;

a developing frame having an opening portion through which a portion of the developing roller is exposed;

a latent image forming unit, provided below the developing roller, for forming the latent image onto the image bearing member;

a first member, provided spaced apart from the developing roller along a longitudinal direction of the developing roller, for receiving a developer that falls from an exposed portion of the developing roller to prevent the developer from falling onto the latent image forming unit; and a second member for receiving the developer that falls passing an outside of the first member in the longitudinal direction to prevent the developer from falling onto the latent image forming unit.

16. An image forming apparatus according to claim 15, wherein the first member is provided in contact with a circumferential surface of the image bearing member.

17. An image forming apparatus according to claim 15, wherein the first member is a sheet member having flexibility.

18. An image forming apparatus according to claim 15, wherein the first member is provided on the developing frame.

19. An image forming apparatus according to claim 15, further comprising an end member attached to an end portion of the developing frame in the longitudinal direction, wherein the second member receives the developer that falls from a gap between the first member and the end member.

20. An image forming apparatus according to claim 19, wherein the end member serves as a bearing member for rotatably supporting the developing roller with respect to the developing frame.

21. An image forming apparatus according to claim 19, wherein the end member serves as a cover member for covering an end portion of the developing roller in the longitudinal direction.

22. An image forming apparatus according to claim 19, wherein at least one portion of the second member is provided at the end member.

23. An image forming apparatus according to claim 22, wherein the other portion of the second member is provided at the developing frame.

24. An image forming apparatus according to claim 23, wherein a concave portion is provided at one of the one portion and the other portion, while a convex portion is provided at the other of the one portion and the other portion, and the convex portion is inserted into the concave portion.

25. An image forming apparatus according to claim 15, wherein the second member has a blind hole configuration being opened upwardly.

26. An image forming apparatus according to claim 15, wherein, assuming that the second member and the first member are projected to a line parallel to the longitudinal direction, a projected area corresponding to an end portion of the first member is included in a projected area corresponding to the second member.

* * * * *